US007481916B2

(12) United States Patent
Broutin et al.

(10) Patent No.: US 7,481,916 B2
(45) Date of Patent: Jan. 27, 2009

(54) PROCESS FOR ISOMERIZATION OF A C7 FRACTION WITH CO-PRODUCTION OF A CYCLIC MOLECULE-RICH FRACTION

(75) Inventors: Paul Broutin, Chaponost (FR); Dominique Casanave, St. Symphorien d'Ozon (FR); Jean-François Joly, Lyons (FR); Elsa Jolimaitre, Lyons (FR)

(73) Assignee: Institute Francais du Petrole, Rueil Malmaison Cedex (FR)

( * ) Notice: Subject to any disclaimer, the term of this patent is extended or adjusted under 35 U.S.C. 154(b) by 538 days.

(21) Appl. No.: 11/232,246

(22) Filed: Sep. 22, 2005

(65) Prior Publication Data

US 2006/0065576 A1 Mar. 30, 2006

(30) Foreign Application Priority Data

Sep. 22, 2004 (FR) ..... 04 09998

(51) Int. Cl.
*C10G 35/00* (2006.01)

(52) U.S. Cl. ..... 208/133

(58) Field of Classification Search ..... 208/46, 208/133–141
See application file for complete search history.

(56) References Cited

U.S. PATENT DOCUMENTS

| | | | | |
|---|---|---|---|---|
| 5,139,645 | A | 8/1992 | Maxwell et al. | |
| 7,273,958 | B2 * | 9/2007 | Bournay et al. | 585/324 |
| 2002/0043480 | A1 | 4/2002 | Ducreux et al. | |

FOREIGN PATENT DOCUMENTS

| | | |
|---|---|---|
| EP | 0 462 673 | 12/1991 |
| EP | 1 182 247 | 2/2002 |

* cited by examiner

*Primary Examiner*—Glenn Caldarola
*Assistant Examiner*—Randy Boyer
(74) *Attorney, Agent, or Firm*—Millen, White, Zelano & Branigan, P.C.

(57) ABSTRACT

Process for the production of a RON isomerate that is at least equal to 80 and that contains less than 1% by weight of aromatic compounds and a fraction that for the most part contains methylcyclohexane (MCH) and optionally toluene, starting from a fraction with 7 carbon atoms.

12 Claims, 1 Drawing Sheet

Figure 1:
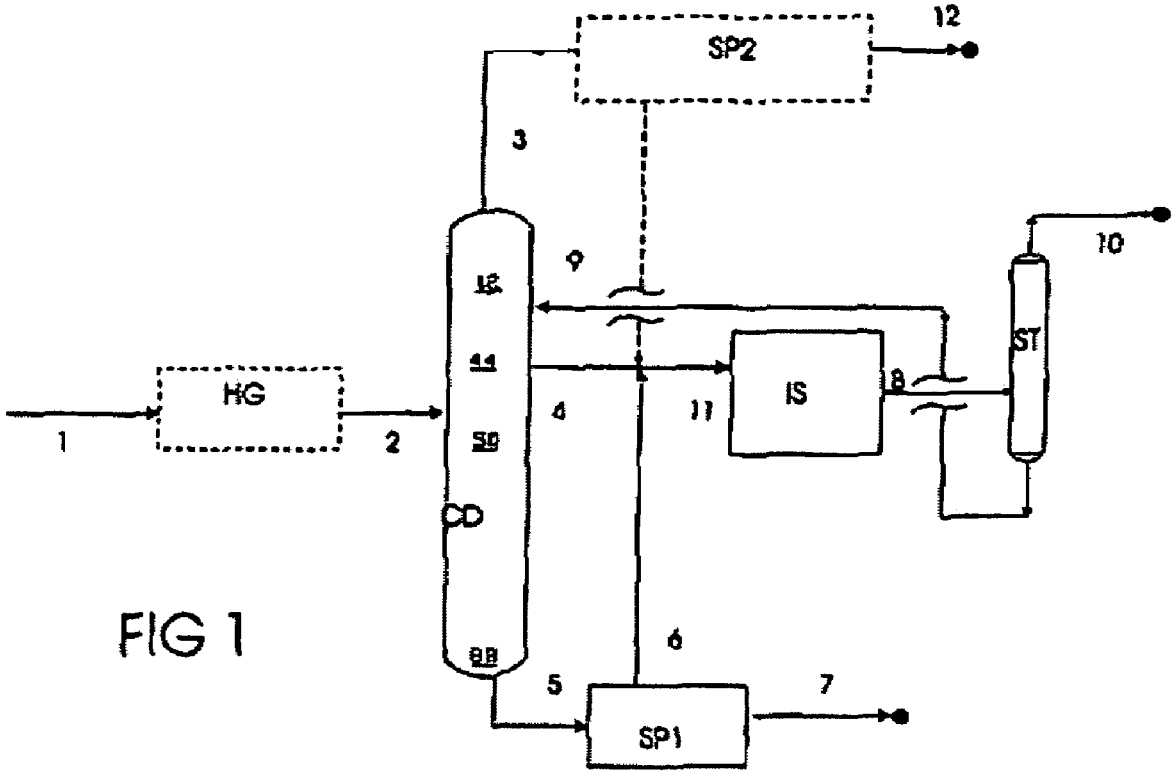

PROCESS FOR ISOMERIZATION OF A C7 FRACTION WITH CO-PRODUCTION OF A CYCLIC MOLECULE-RICH FRACTION

FIELD OF THE INVENTION

The elimination of lead alkyls in automobile gasolines and more recently the limitation of aromatic compound contents in the gasolines (35% in 2005 compared to 42% currently) generated a development of production processes of branched paraffins that have a much better octane number than the linear paraffins and in particular the process for isomerization of normal paraffins into branched paraffins.

This process is currently taking on a growing importance in the petroleum industry.

The current schemes for upgrading the naphtha ($C_5$-$C_{10}$ fraction) that is obtained from the atmospheric distillation of the petroleum most often comprise a fractionation that produces:

- a light naphtha ($C_5$-$C_6$ fraction) that is sent to isomerization,
- a heavy naphtha ($C_7$-$C_{10}$ fraction) that is sent to catalytic reforming.

The isomerization product (or isomerate) is free of aromatic compounds contrary to the reformate that in general contains a large amount thereof due to the reactions for dehydrocyclization of paraffins and for dehydrogenation of naphthenes.

Isomerate and reformate are usually sent to the gasoline pool in which other bases, such as the gasoline that is obtained from fluidized-bed catalytic cracking (FCC) or additives such as methyl-tert-butyl ether (MTBE), can also be involved.

The aromatic compounds have high octane numbers that are favorable to their use in controlled-ignition engines, but for environmental reasons, their total content in the gasolines is increasingly limited.

From 2005, the European specification calls for reducing to a maximum of 35% by volume the total content of aromatic compounds in the super fuels, whereas currently said content is on the order of 42% by volume.

Also, it is imperative to develop new processes that make it possible to synthesize new bases that are free of aromatic compounds but that have high octane numbers.

This invention relates more particularly to the isomerization of the $C_7$-rich fraction that is obtained from the atmospheric distillation naphtha.

Table 1 below provides the research octane number (RON) and the boiling points of the primary hydrocarbon compounds that are present in the C7 fraction that is obtained from the atmospheric distillation naphtha:

TABLE 1

| | RON | $T_{b.p.}$ (° C.) |
|---|---|---|
| Trimethyl 2-2-3 butane | 112.1 | 80.8 |
| Dimethyl 2-2 pentane | 92.8 | 79.2 |
| Dimethyl 2-4 pentane | 83.1 | 80.5 |
| Dimethyl 3-3 pentane | 80.8 | 86 |
| Dimethyl 2-3 pentane | 91.1 | 89.7 |
| Methyl-2 hexane | 42.4 | 90 |
| Methyl-3 hexane | 52 | 91.9 |
| Ethyl-3 pentane | 65 | 93.4 |
| n-Heptane | 0 | 98.4 |
| Dimethyl-1,1 cyclopentane | 92.3 | 87.8 |
| cis-Dimethyl-1,3 cyclopentane | 79.2 | 90.8 |
| trans-Dimethyl-1,3 cyclopentane | 80.6 | 91.7 |
| trans-Dimethyl-1,2 cyclopentane | 80.6 | 91.8 |
| Methyl-cyclohexane | 74.8 | 100.9 |

TABLE 1-continued

| | RON | $T_{b.p.}$ (° C.) |
|---|---|---|
| Ethyl-cyclopentane | 67.2 | 103.4 |
| Toluene | 120 | 110.7 |

The consideration of octane numbers of different $C_7$ isomers shows that the isomers of normal heptane (n-$C_7$) have several branches, i.e., the di- and tri-branched isomers have an octane number (from 80 to 110) that is high enough to be able to be sent directly into the gasoline pool.

In contrast, the isomers that have only a single branch or are mono-branched have octane numbers (42 for methyl-2 hexane; 52 for methyl-3 hexane) that are inadequate for being mixed in the gasoline pool.

These compounds should therefore be transformed as much as possible into di- or tri-branched paraffins in the isomerization process.

Regarding the normal heptane, the problems are even more pronounced. Whereby its octane number is zero, it absolutely must be converted until used up in the isomerization process.

Up to 1% by weight of nC7 in the isomerate and, if possible, less than 0.5% by weight can be tolerated.

Furthermore, the toluene that is present in the fresh feedstock can be totally hydrogenated in methyl-cyclohexane (MCH), either in a specific hydrogenation unit or in the unit for isomerization of paraffins.

Now, the methyl-cyclohexane that is present in the feedstock in a large amount is not very affected by isomerization, whereby the isomerization catalysts do not promote the opening of naphthene rings in their usual conditions of use.

Now, the $C_7$ isomerate that is obtained can contain up to 30% by weight of methyl-cyclohexane, a compound whose RON is less than 75, which further significantly increases the RON of the $C_7$ isomerate that is obtained.

It is therefore advantageous to separate the methylcyclohexane (MCH) from the C7 paraffinic feedstock before feeding the isomerization.

The MCH can then be used either as solvent, or optionally it can be reintroduced into the gasoline pool within the limits allowed by its relatively low RON.

The problem that this invention seeks to solve is therefore that of the production of gasoline bases from a $C_7$ fraction that corresponds to a research octane number (RON) of at least 80, with a limited content of aromatic compounds, which makes it possible to anticipate the new regulation on the specifications of the gasoline pool.

The solution that is proposed in this invention consists of a process for treatment of a C7 fraction, generally obtained from an atmospheric distillation, so as to obtain two fractions:

- a first fraction that for the most part contains paraffins that is sent into an isomerization unit, and
- a second fraction that for the most part contains methylcyclohexane (MCH), which, according to requirements, can be updated as solvent, or optionally reintroduced at least in part into the gasoline pool, while adhering to the specification on the RON.

EXAMINATION OF THE PRIOR ART

There are relatively few patents that relate to the upgrading of the C7 fraction by isomerization, most of them relating to the treatment by isomerization of C5-C6 fractions.

In addition, none of these processes makes possible the simultaneous production of a cyclic molecule-rich fraction such as methylcyclohexane.

U.S. Pat. No. 6,069,289 describes a process for separation of multi-branched paraffins, optionally coupled to an isomerization, but the treated feedstock does not contain naphthenic compounds and aromatic compounds.

U.S. Pat. No. 6,338,791 describes a separation process that is coupled to an isomerization reactor. The separation process makes it possible to produce a fraction that is rich in multi-branched paraffins and optionally rich in saturated or unsaturated cyclic compounds. This process therefore makes it possible to produce only a single fraction because the naphthenes and aromatic compounds of the feedstock are not separated from paraffins and are therefore injected into the isomerization reactor.

Other references to particular points will be provided in the detailed description of the invention.

SUMMARY PRESENTATION OF THE INVENTION

This invention should be replaced in the more general context of treatment of the naphtha fraction that is obtained from the atmospheric distillation of the crude.

The naphtha fraction is generally separated into 3 fractions in a distillation column:

1) A top fraction that essentially comprises the compounds with 5 and 6 carbon atoms that is sent into a specific isomerization whose operating conditions and whose catalyst may be different from those used for the isomerization of the $C_7$ fraction.
2) A fraction with 7 carbon atoms that is the subject of the treatment described in this invention and that ends with an effluent with 7 carbon atoms containing at least 70% by weight of di- and tri-branched paraffins, and whose octane number is between 80 and 87.
3) A bottom fraction essentially containing compounds with 8 carbon atoms and more that is sent into a catalytic reforming unit.

This invention relates to the treatment of the fraction with 7 carbon atoms that is obtained from the preceding fractionation, but, given the performance levels of the naphtha fractionation column, it may be possible to find in said $C_7$ fraction up to 10% of lighter compounds with 6 carbon atoms or less and up to 10% of heavier compounds with 8 carbon atoms and more.

This invention takes into account these compounds that are adjacent to the C7 fraction itself that will henceforth be called "C7 fraction" for the sake of simplicity.

This invention relates to a process for the production of multi-branched paraffins with 7 carbon atoms, making it possible to obtain an isomerate that has an octane number that is at least equal to 80 with a content of aromatic compounds that is less than 1% by weight, and preferably less than 0.5% by weight, starting from a feedstock that for the most part comprises hydrocarbons with 7 carbon atoms belonging to the families of paraffins, naphthenes and aromatic compounds.

In the following description, the abbreviation $C_7$ fraction will be used to designate a feedstock that comprises a majority of hydrocarbons with 7 carbon atoms, i.e., at least 60% by weight, whereby this $C_7$ fraction is generally obtained from a first distillation naphtha and has a chemical composition that varies with the origin of the naphtha fraction.

The invention applies to a C7 fraction that is obtained from an atmospheric distillation naphtha, but more generally it applies to a C7 fraction that has any proportions of paraffins, naphthenes and aromatic compounds. Any proportions is defined as any proportion set in which the paraffin, naphthene and aromatic compound families are present at a rate of at least 1% by weight.

One of the objectives of the process that is the object of this invention is to transform this $C_7$ fraction into a fraction that contains for the most part multi-branched $C_7$ paraffins, i.e., that exhibit a degree of branching that is greater than or equal to two.

A second objective of this invention is to co-produce a fraction that is rich in cyclic, naphthenic and optionally aromatic molecules.

The invention therefore consists of a process for the production of a RON isomerate that is at least equal to 80, and for co-production of a naphthenic fraction that consists for the most part of methylcyclohexane and optionally toluene, starting from a C7 fraction of hydrocarbons, containing paraffins, naphthenes and aromatic compounds in any proportion, whereby said process employs at least one distillation column that makes it possible to separate the feedstock into a top flow, a bottom flow, and a lateral flow, an isomerization unit, and at least one unit for separating normal paraffins and cyclic molecules, in particular methylcyclohexane, characterized in that the aromatic compound content of the isomerate is less than 1% by weight and preferably less than 0.5% by weight.

In a preferred embodiment of the invention, the fresh feedstock is introduced into a distillation column from which are extracted a) a top flow that provides the isomerate that is produced, b) a lateral flow that feeds in a mixture one of the isomerization units, and c) a bottom flow that is introduced into a unit for separating normal paraffins, on the one hand, and cyclic molecules, on the other hand, in particular methylcyclohexane, whereby normal paraffins are introduced in a mixture with lateral flow into at least one isomerization unit, and the naphthenic fraction that is produced with a purity level that is at least equal to 90% by mass.

After stabilization, the effluent from the isomerization is sent back to the distillation column at a level (typically on a plate) that is located above the level (plate) of lateral draw-off. Recycling is conducted of normal paraffins that are contained in the isomerization effluent (IS) after passage into a stabilization column (ST) toward distillation column (CD) so as to minimize their content in the top flow of said column. Taking into account slightly higher boiling points of the normal paraffins and mono-branched paraffins, the latter will have a tendency to be brought back down into the column, while the di-branched paraffins and tri-branched paraffins with the slightly lower boiling points will emerge for the most part at the top.

In a variant of the invention, the top flow of the distillation column can be sent into a unit for separating normal paraffins and mono-branched paraffins, on the one hand, and di-branched paraffins and tri-branched paraffins, on the other hand, whereby the normal paraffins and mono-branched paraffins are reintroduced into the isomerization unit, and the di-branched paraffins and tri-branched paraffins constitute the isomerate.

In another variant of the invention, fresh feedstock can be introduced upstream from the distillation column into a unit for hydrogenating toluene, which makes it possible to transform the latter into methylcyclohexane, whereby the effluent of said hydrogenation unit is introduced as a feedstock of the distillation column.

The distillation column may be of the type: column with an internal wall.

In some cases, the unit for separating normal paraffins, on the one hand, and cyclic molecules, on the other hand, can be carried out by an adsorption process.

In other cases, the unit for separating normal paraffins, on the one hand, and cyclic molecules, on the other hand, can be carried out by a membrane process.

SUMMARY DESCRIPTION OF THE FIGURE

FIG. 1 shows the diagram of the process according to the invention in its preferred variant, comprising a unit for hydrogenating toluene upstream from the distillation column, and a unit for separating mono-branched paraffins and di-branched paraffins in the top flow that is obtained from the distillation column.

The unit for hydrogenating toluene and the unit for separating mono-branched paraffins and di-branched paraffins on the top flow are optional and are indicated in dotted lines in FIG. 1.

DETAILED DESCRIPTION OF THE INVENTION

The detailed description of the invention will be better understood by following the process diagram of FIG. 1.

The feedstock that is used to illustrate the invention is a C7 fraction that is obtained from an atmospheric distillation naphtha. It has the chemical composition that is given below:

normal heptane of 20 to 40% by weight,
methyl-2 hexane of 5 to 15% by weight,
methyl-3 hexane of 10 to 20% by weight,
methyl-cyclohexane of 5 to 30% by weight,
toluene of 0 to 15% by weight.

In the basic configuration of the invention, fresh feedstock (1) is introduced into a distillation column (CD) from which are extracted a) a top flow (3) that provides the isomerate that is produced, b) a lateral flow (4) that feeds in a mixture one of isomerization units (IS), and c) a bottom flow (5) that is introduced into a unit (SP1) for separating normal paraffins, on the ore hand, and cyclic molecules, on the other hand, in particular methylcyclohexane.

Flow (7) that represents the effluent of separating unit (SP1) consists of at least 90% by mass of cyclic molecules that may or may not be saturated.

Flow (6) that consists of a majority of normal paraffins is reintroduced into a mixture with lateral flow (4) to constitute flow (11) at the inlet of isomerization unit (IS).

Effluent (8) of isomerization unit (IS) is sent into a stabilization column (ST) from which a flow (9) comes out at the bottom and is sent to distillation column (CD). This flow (9) is reintroduced into column (CD) on a plate that is located above the lateral draw-off plate so as to create drainage of normal paraffins whose content in top flow (3) of column (CD) generally will be less than 1% by weight and preferably less than 0.5% by weight.

Flow (10) that exits at the top of the stabilization column constitutes a gas fraction that is sent to the fuel pool of the refinery.

Top flow (3) of distillation column (CD) constitutes the isomerate.

For the purpose of maximizing the di-branched and tri-branched content in the isomerate, and according to a variant of the invention, top flow (3) of distillation column (CD) can be sent into a unit (SP2) for separating normal paraffins and mono-branched paraffins, on the one hand, and di-branched paraffins and tri-branched paraffins, on the other hand, whereby the normal paraffins and mono-branched paraffins are reintroduced into isomerization unit (IS). In this variant, the isomerate consists of flow (12).

According to another variant of the invention, fresh feedstock (1) can be introduced upstream from distillation column (CD) into a unit for hydrogenating toluene (HG), which makes it possible to transform the latter into methylcyclohexane. The effluent of this hydrogenation unit constitutes flow (2) and is sent as a supply of distillation column (CD).

Finally, according to another variant of the invention, the distillation column can be of the type: column with an internal wall.

This type of column, well known to one skilled in the art, makes possible the fractionation by distillation of a feedstock into three separate fractions, with an energy increase that is required for the separation on the order of 20-30% relative to a standard distillation column.

The process, object of this invention, therefore comprises at least one distillation column (CD), at least one unit (SP1) for separating normal paraffins and cyclic molecules (methylcyclohexane and optionally toluene) that make it possible to send to isomerization unit (IS) only the paraffinic fraction of the C7 fraction, and at least one isomerization unit (IS) that is fed by the lateral flow of distillation column (CD) and by the normal paraffins that are obtained from separation unit (SP1).

Separation unit (SP1) between n-heptane and the cyclic molecules, primarily methylcyclohexane and optionally toluene, can make use of any technique that is known to one skilled in the art.

Among the latter, it is possible to cite the process for adsorption by pressure variation that is known under the abbreviation PSA or the process of separation by simulated countercurrent (CCS).

In the case where separation (SP1) is carried out by an adsorption unit, any adsorbent or adsorbent mixture that has a selectivity in favor of normal heptane or in favor of cyclic molecules can be used, in particular an LTA-type zeolite that selectively adsorbs the normal paraffins and excludes the molecules with larger molecular diameters, such as the cyclic molecules that may or may not be saturated The separation by adsorption (SP1) can be carried out in gas phase by a PSA-type process. In this case, the operating temperature of the unit is between 150 and 400° C.

The pressure of the column during the adsorption phase is between 2 and 20 bar (1 bar=10 5 Pascals) and during the desorption phase between 0.5 and 3 bar.

The desorbent that is used can be a cover gas, such as hydrogen or nitrogen or a hydrocarbon, such as C3-C6 paraffins.

Desorbents that are particularly well suited for this separation are the normal paraffins.

One of the preferred desorbents is the normal butane, whose boiling point is very far from that of nC7, and that it is therefore possible to easily separate from this molecule.

Hydrogen is also a desorbent that is particularly well suited for this separation, because it can be directly recycled in the isomerization reactor with the desorbate (nC7-rich effluent of the desorption unit).

Such a separating unit (SP1) makes it possible to produce MCH or an MCH+toluene mixture with a purity of between 95 and 99% by mass, and a yield of between 50 and 95%.

Alternately, the separation by adsorption (SP1) can be carried out in liquid phase by a CCS-type process. In this case, the operating temperature of the unit is between 100 and 250° C. The pressure of the column during the adsorption phase is between 2 and 20 bar.

The desorbent that is used is preferably a hydrocarbon and can be in particular C3-C6 paraffins.

Desorbents that are particularly suited for this separation are normal paraffins.

Such a unit for separation by CCS makes it possible to produce MCH or an MCH +toluene mixture with a purity of between 95 and 99.5% by mass, and a yield of between 50 and 98%.

It is also possible to carry out said separation (SP1) by using one or more membrane modules. The silicalite membranes, such as those described in U.S. Pat. No. 5,871,165 are known to have a selectivity of a form in favor with normal paraffins. It is also possible to carry out the separation of paraffins and cyclic molecules by means of an extraction by solvent such as the one described in U.S. Pat. No. 3,169,998, which is of liquid/liquid type, whereby the solvent that is used is gamma-butyrolactone.

The process also comprises at least one isomerization unit (IS) that makes it possible to transform the normal paraffins and mono-branched paraffins into multibranched paraffins, such as the unit that is described in Patent FR 01/10566. The isomerization catalyst that is used in said unit will be included in the group that consists of the supported catalysts that contain at least one halogen and at least one metal of group VIII, whereby the zeolitic catalysts contain at least one metal of group VIII, the Friedel and Crafts catalysts, the super-acid catalysts such as HPA on zirconia, Wox on zirconia or sulfated zirconia.

The total pressure in the isomerization reaction zone is approximately 10 to 50 bars relative, whereby the hourly volumetric flow rate is approximately 0.2 to 10 h−1.

The hydrogen/hydrocarbon molar ratio is located between 0.06 and 30 mol/mol.

The temperature in the reaction zone is between 50 and 150° C., and preferably between 60 and 100° C.

The process optionally comprises a separation unit (SP2) that is fed by the top flow of column (CD) and that makes it possible to separate the normal paraffins and mono-branched paraffins, on the one hand, and the multibranched paraffins, on the other hand, so as to recycle normal paraffins and monobranched paraffins to the isomerization unit and to maximize the production of multi-branched paraffins.

Process (SP2) for separating normal paraffins and mono-branched paraffins and multi-branched paraffins can be based on any technique that is known to one skilled in the art.

It is possible in particular to use a separation by distillation by taking as a basis the difference of boiling points of these different compounds (cf. Table 1).

It is also possible to use a process for separation by adsorption on a molecular sieve such as the one that is described in Patent Application U.S. 20020045793 A1.

The adsorbent that is used in said unit can be any adsorbent that is known to one skilled in the art that makes it possible to make this separation, for example the adsorbents that are described in U.S. Pat. No. 6,353,144, FR 02/09841 and Patent Application U.S. 20020045793 A1, cited above.

It is also possible to consider using one or more membrane modules for this separation, as described in, for example, the Patent EP 0 922 748.

Process (SP2) for separating normal paraffins and mono-branched paraffins and multi-branched paraffins can also be based on a coupling of different techniques.

In particular, in one of the preferred versions of the process, the separation is partially carried out by distillation to produce an intermediate feedstock that is high in di-branched paraffins and is low in mono-branched paraffins.

This intermediate feedstock is then treated in a unit for separation by adsorption to obtain the final desired purity of di-branched paraffins.

Finally, the process that is the object of this invention can also comprise a unit for hydrogenating toluene (HG) that is contained in the feedstock so as to transform this toluene into methylcyclohexane.

The hydrogenation catalyst that is used in said unit is a supported catalyst that contains at least one metal of group VIII.

The total pressure in the reaction zone can be between 2 and 70 bars relative, and preferably between 5 and 50 bars relative.

The hydrogen/hydrocarbon molar ratio is between 1 and 15 mol/mol.

The temperature in the reaction zone is between 50 and 300° C. and preferably between 100 and 200° C. The hourly volumetric flow rate will be between 2 and 20 h−1.

EXAMPLE 1

This example illustrates one of the preferred variants of the invention in which the feedstock to be treated (1) is introduced into a reactor for specific hydrogenation of toluene (HG) then into a distillation column (CD) that comprises 88 real plates. The introduction of the feedstock is carried out at plate 50.

The lateral flow is extracted from the column at plate 44, and the recycling of isomerization effluents (IS) after stabilization (ST) is carried out at plate 15.

The toluene hydrogenation reactor works under the following operating conditions:

T=160° C.

P=5 bars relative

Hydrogen/hydrocarbon molar ratio=5 mol/mol

VVH=5 h−1 with a catalyst that is based on Pt on alumina.

In the example being considered, fresh feedstock (1) has the following composition (in % by weight):

| | |
|---|---|
| Dimethyl 2-3 butane | 0.01 |
| Methyl-2 pentane | 0.13 |
| Methyl-3 pentane | 0.16 |
| n-Hexane | 1.41 |
| Methyl-cyclopentane | 0.63 |
| Cyclohexane | 1.71 |
| Benzene | 0.37 |
| Trimethyl 2-2-3 butane | 0.08 |
| Dimethyl 2-2 pentane | 0.20 |
| Dimethyl 2-3 pentane | 3.57 |
| Dimethyl 2-4 pentane | 0.50 |
| Dimethyl 3-3 pentane | 0.26 |
| Methyl-2 hexane | 8.97 |
| Methyl-3 hexane | 12.25 |
| Ethyl-3 pentane | 1.14 |
| n-Heptane | 31.39 |
| Dimethyl-1,1 cyclopentane | 0.82 |
| cis-Dimethyl-1,3 cyclopentane | 2.29 |
| trans-Dimethyl-1,3 cyclopentane | 2.21 |
| trans-Dimethyl-1,2 cyclopentane | 4.19 |
| Methyl-cyclohexane | 12.96 |
| Ethyl-cyclopentane | 0.73 |
| Toluene | 13.52 |
| $C_{8+}$ | 0.50 |

The effluent from the reactor for hydrogenating toluene is sent into a distillation column (CD) from which are extracted 3 flows:

a top flow (3) that corresponds to the isomerate that is produced.

a lateral flow (4) that contains a majority (at least 70%) of normal heptane and mono-branched C7 paraffins that will feed the isomerization unit.

A bottom flow (5), rich in methylcyclohexane and in n-heptane, that is sent into a separation unit between paraffins and naphthenes.

The separation unit between the paraffins and the naphthenes produces two effluents; one effluent (6) that is rich in n-heptane and an effluent (7) that is rich in methylcyclohexane.

Flow (6) is mixed with flow (4) to provide a flow (11) that constitutes the feedstock of isomerization unit (IS) that uses a catalyst that is based on platinum on chlorinated alumina such as the one that is described in Application U.S. 20020002319 A1.

The isomerization unit works under the following conditions:

Temperature: 90° C.

Pressure: 30 bars effective

PPH=1 h−1

Hydrogen/hydrocarbon molar ratio=0.2 mol/mol.

At the top of column (CD), a flow (3) exits that corresponds to the isomerate that is produced whose composition by weight and mass flow rate are as follows:

| | |
|---|---|
| Isopentane | 0 |
| Dimethyl 2-2 butane | 0.01 |
| Dimethyl 2-3 butane | 0.01 |
| Methyl-2 pentane | 0.52 |
| Methyl-3 pentane | 0.42 |
| n-Hexane | 2.37 |
| Methyl-cyclopentane | 1.43 |
| Cyclohexane | 3.91 |
| Benzene | 0.00 |
| Trimethyl 2-2-3 butane | 7.38 |
| Dimethyl 2-2 pentane | 26.39 |
| Dimethyl 2-3 pentane | 0.82 |
| Dimethyl 2-4 pentane | 47.01 |
| Dimethyl 3-3 pentane | 2.62 |
| Methyl-2 hexane | 4.09 |
| Methyl-3 hexane | 1.73 |
| Ethyl-3 pentane | 0.06 |
| n-Heptane | 0.50 |
| Dimethyl-1,1 cyclopentane | 0.15 |
| cis-Dimethyl-1,3 cyclopentane | 0.06 |
| trans-Dimethyl-1,3 cyclopentane | 0.05 |
| trans-Dimethyl-1,2 cyclopentane | 0.05 |
| Methyl-cyclohexane | 0.24 |
| Ethyl-cyclopentane | 0.00 |
| Toluene | 0.00 |
| $C_{8+}$ | 0.00 |

The RON of this isomerate (flow 3) is 84.3, and its aromatic compound content is 0.00% by weight.

The composition of flow (7) that is obtained from the separation unit by adsorption is as follows in percent by weight:

| | |
|---|---|
| Dimethyl 2-2 butane | 0.01 |
| Dimethyl 2-3 butane | 0.00 |
| Methyl-2 pentane | 0.0 |
| Methyl-3 pentane | 0.0 |
| n-Hexane | 0.0 |
| Methyl-cyclopentane | 0.00 |
| Cyclohexane | 0.0 |
| Benzene | 0.0 |
| Trimethyl 2-2-3 butane | 0.00 |

-continued

| | |
|---|---|
| Dimethyl 2-2 pentane | 0.00 |
| Dimethyl 2-3 pentane | 0.04 |
| Dimethyl 2-4 pentane | 0.00 |
| Dimethyl 3-3 pentane | 0.00 |
| Methyl-2 hexane | 0.15 |
| Methyl-3 hexane | 0.87 |
| Ethyl-3 pentane | 0.22 |
| n-Heptane | 1.02 |
| Dimethyl-1,1 cyclopentane | 0.0 |
| cis-Dimethyl-1,3 cyclopentane | 0.03 |
| trans-Dimethyl-1,3 cyclopentane | 0.06 |
| trans-Dimethyl-1,2 cyclopentane | 0.11 |
| Methyl-cyclohexane | 94.78 |
| Ethyl-cyclopentane | 2.72 |
| Toluene | 0.00 |
| $C_{8+}$ | 0.00 |

The values of mass flow rates of primary flows are provided in Table 2 below:

TABLE 2

| | Flow (1) | Flow (3) | Flow (7) |
|---|---|---|---|
| Mass Flow Rate (kg/h) | 11000 | 5540 | 4155 |

Summary Table 3 below provides a comparison of the flow properties:

TABLE 3

| | Flow (1) of Example 1 | Flow (3) of Example 1 | Flow (7) of Example 1 |
|---|---|---|---|
| % Paraffins | 60.56 | 94.11 | 2.31 |
| % Aromatic Compounds | 13.09 | 0.00 | 0 |
| % Naphthenes | 25.54 | 5.89 | 97.69 |
| RON | 50.7 | 84.3 | 73.9 |

Table 3 above shows that the process of Example 1 according to the invention makes it possible to co-produce, starting from the C7 fraction (flow 1) that is obtained from the atmospheric distillation, containing 13% of aromatic compounds and with a very low RON, an effluent (flow 3) that is very low in aromatic compounds and with a RON that is compatible with a use in the gasoline pool and a high-purity naphthenic fraction (flow 7) that can be upgraded as solvent.

EXAMPLE 2

In this example, the process as described in Example 1 is used again (in particular the composition of the fresh feedstock is identical to that of flow (1)), but by not treating the fresh feedstock in the reactor for hydrogenation of toluene.

The composition of flow (3) at the top of distillation column CD is then as follows in % by weight:

| | |
|---|---|
| Dimethyl 2-2 butane | 0.09 |
| Dimethyl 2-3 butane | 0.09 |
| Methyl-2 pentane | 0.51 |
| Methyl-3 pentane | 0.42 |
| n-Hexane | 2.40 |
| Methyl-cyclopentane | 1.49 |
| Cyclohexane | 3.93 |
| Benzene | 0.00 |
| Trimethyl 2-2-3 butane | 7.54 |

-continued

| | |
|---|---|
| Dimethyl 2-2 pentane | 25.92 |
| Dimethyl 2-3 pentane | 0.85 |
| Dimethyl 2-4 pentane | 47.09 |
| Dimethyl 3-3 pentane | 2.78 |
| Methyl-2 hexane | 4.19 |
| Methyl-3 hexane | 1.75 |
| Ethyl-3 pentane | 0.07 |
| n-Heptane | 0.5 |
| Dimethyl-1,1 cyclopentane | 0.11 |
| cis-Dimethyl-1,3 cyclopentane | 0.04 |
| trans-Dimethyl-1,3 cyclopentane | 0.04 |
| trans-Dimethyl-1,2 cyclopentane | 0.03 |
| Methyl-cyclohexane | 0.15 |
| Ethyl-cyclopentane | 0.01 |
| Toluene | 0.00 |
| $C_{8+}$ | 0.00 |

The composition of flow (7) that is obtained from the separation unit by adsorption is as follows in percent by weight:

| | |
|---|---|
| Dimethyl 2-2 butane | 0.0 |
| Dimethyl 2-3 butane | 0.02 |
| Methyl-2 pentane | 0.0 |
| Methyl-3 pentane | 0.0 |
| n-Hexane | 0.0 |
| Methyl-cyclopentane | 0.00 |
| Cyclohexane | 0.0 |
| Benzene | 0.0 |
| Trimethyl 2-2-3 butane | 0.00 |
| Dimethyl 2-2 pentane | 0.00 |
| Dimethyl 2-3 pentane | 0.01 |
| Dimethyl 2-4 pentane | 0.00 |
| Dimethyl 3-3 pentane | 0.00 |
| Methyl-2 hexane | 0.04 |
| Methyl-3 hexane | 0.35 |
| Ethyl-3 pentane | 0.12 |
| n-Heptane | 0.76 |
| Dimethyl-1,1 cyclopentane | 0.0 |
| cis-Dimethyl-1,3 cyclopentane | 0.03 |
| trans-Dimethyl-1,3 cyclopentane | 0.05 |
| trans-Dimethyl-1,2 cyclopentane | 0.11 |
| Methyl-cyclohexane | 70.22 |
| Ethyl-cyclopentane | 2.96 |
| Toluene | 25.34 |
| $C_{8+}$ | 0.00 |

The values of mass flow rates of the primary flows are provided in Table 4 below:

TABLE 4

| | Flow (1) | Flow (3) | Flow (7) |
|---|---|---|---|
| Mass Flow Rate (kg/h) | 11000 | 5509 | 4053 |

Comparison of the Flow Properties:

TABLE 5

| | Flow (1) of Example 2 | Flow (3) of Example 2 | Flow (7) of Example 2 | Flow (3) + (7) of Example 2 |
|---|---|---|---|---|
| % Paraffins | 60.56 | 94.06 | 1.29 | 54.81 |
| % Aromatic Compounds | 13.09 | 0.00 | 25.34 | 10.74 |
| % Naphthenes | 25.54 | 5.94 | 73.37 | 34.45 |
| RON | 50.7 | 84.1 | 82.8 | 83.5 |

Table 5 above shows that the process of Example 2 according to the invention makes it possible to produce a paraffinic fraction without aromatic compounds (flow 3) and a fraction that is rich in cyclic molecules (flow 7), both RON being compatible with use in the gasoline pool. It is therefore possible to recombine the two flows (flow 3+flow 7) to obtain a fraction that is low in aromatic compounds relative to the feedstock (flow 1) and with a RON that is clearly more than 80 which corresponds to the problem posed of maintaining the RON specification with a limited content of aromatic compounds.

The invention claimed is:

1. A process for the production of an isomerate that is at least equal to 80 and for co-production of a naphthenic fraction comprising mostly methylcyclohexane and optionally toluene, starting from a fresh C7 hydrocarbon feedstock containing paraffins, naphthenes and aromatic compounds, said process comprising at least one distillation column, at least one isomerization unit, and at least one unit for separating normal paraffins from cyclic molecules, wherein an isomerate is produced containing less than 1% by weight of aromatic compounds, and fresh feedstock is introduced into said distillation column from which are extracted a) a top flow that contains said isomerate, b) a lateral flow that feeds into an isomerization unit, and c) a bottom flow that is introduced into said unit for separating normal paraffins from cyclic molecules, and said normal paraffins are introduced in a mixture with the lateral flow into said isomerization unit and the resultant naphthenic fraction is produced with a purity level that is at least equal to 90% by mass.

2. A process according to claim 1, wherein one of the isomerization units is fed by the lateral draw-off that is obtained from said distillation column, and after stabilization, the effluent of the isomerization is sent back into the distillation column at a level located above the level of the lateral draw-off.

3. A process according to claim 1, wherein the top flow of the distillation column is sent into a unit for separating normal paraffins and mono-branched paraffins from di-branched paraffins and tri-branched paraffins and the normal paraffins and mono-branched paraffins are reintroduced into the isomerization unit, and the di-branched paraffins and tri-branched paraffins constitute the isomerate.

4. A process according to claim 1, wherein the fresh feedstock is introduced upstream from the distillation column into a unit for hydrogenating toluene so as to transform the latter into methylcyclohexane.

5. A process according to claim 1, wherein the separation of the normal paraffins from the cyclic molecules is carried out by an adsorption process.

6. A process according to claim 1, wherein the separation of normal paraffins from the cyclic molecules is carried out by a membrane process.

7. A process according to claim 1, wherein the isomerate contains less than 0.5% by weight of aromatic compounds.

8. A process according to claim 1, wherein the cyclic molecules comprise methylcyclohexane.

9. A process according to claim 2, wherein the top flow of the distillation column is sent into a unit for separating normal paraffins and mono-branched paraffins from di-branched paraffins and tri-branched paraffins and the normal paraffins and mono-branched paraffins are reintroduced into the isomerization unit, and the di-branched paraffins and tri-branched paraffins constitute the isomerate.

10. A process according to claim 2, wherein the fresh feedstock is introduced upstream from the distillation column into a unit for hydrogenating toluene so as to transform the latter into methylcyclohexane.

11. A process according to claim 3, wherein the fresh feedstock is introduced upstream from the distillation column into a unit for hydrogenating toluene so as to transform the latter into methylcyclohexane.

12. A process to claim 9, wherein the fresh feedstock is introduced upstream from the distillation column into a unit for hydrogenating toluene so as to transform the latter into methylcyclohexane.

* * * * *

UNITED STATES PATENT AND TRADEMARK OFFICE

CERTIFICATE OF CORRECTION

PATENT NO. : 7,481,916 B2
APPLICATION NO. : 11/232246
DATED : January 27, 2009
INVENTOR(S) : Paul Broutin et al.

It is certified that error appears in the above-identified patent and that said Letters Patent is hereby corrected as shown below:

Column 12, lines 14 and 15 read "A process for the production of an isomerate that is at least equal to 80 and for co-production of a naphthenic fraction" should read -- A process for the production of an isomerate having a research octane number of at least equal to 80 and for co-production of a naphthenic fraction. --

Column 12, lines 30 through 35 read "A process according to claim 1, wherein one of the isomerization units is fed by the lateral draw-off that is obtained from said distillation column, and after stabilization, the effluent of the isomerization is sent back into the distillation column at a level located above the level of the lateral draw-off." should read -- A process according to claim 1, wherein said at least one isomerization unit is fed by the lateral draw-off that is obtained from said distillation column, and after stabilization, the effluent of the at least one isomerization unit is sent back into the distillation column at a level located above the level of the lateral draw-off. --

Signed and Sealed this

First Day of September, 2009

David J. Kappos

David J. Kappos
*Director of the United States Patent and Trademark Office*